US009418601B2

(12) United States Patent
Shin et al.

(10) Patent No.: US 9,418,601 B2
(45) Date of Patent: Aug. 16, 2016

(54) DISPLAY DEVICE WITH LUMINANCE BOOSTING UNIT

(71) Applicant: Samsung Display Co. Ltd., Yongin, Gyeonggi-Do (KR)

(72) Inventors: Ho Sik Shin, Gunpo-si (KR); Eui Jeong Kang, Suwon-si (KR); Yong Hoon Kwon, Hwaseong-si (KR); Jung Hyun Kim, Seoul (KR); Hee Kwang Song, Suwon-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 67 days.

(21) Appl. No.: 14/340,657

(22) Filed: Jul. 25, 2014

(65) Prior Publication Data

US 2015/0269894 A1 Sep. 24, 2015

(30) Foreign Application Priority Data

Mar. 19, 2014 (KR) ..... 10-2014-0032228

(51) Int. Cl.
*G09G 3/36* (2006.01)
*G09G 3/34* (2006.01)

(52) U.S. Cl.
CPC ..... *G09G 3/3426* (2013.01); *G09G 3/3413* (2013.01); *G09G 2320/0233* (2013.01); *G09G 2320/066* (2013.01); *G09G 2320/0646* (2013.01); *G09G 2360/16* (2013.01)

(58) Field of Classification Search
CPC ..... G09G 3/36; G09G 3/3413; G09G 3/3426; G09G 2320/066; G09G 2320/0233; G09G 2320/0646; G09G 2360/16
USPC ..... 345/76–84, 87–93, 102, 690
See application file for complete search history.

(56) References Cited

U.S. PATENT DOCUMENTS

| | | | | |
|---|---|---|---|---|
| 6,992,718 | B1 * | 1/2006 | Takahara | 348/333.09 |
| 8,373,640 | B2 * | 2/2013 | Ishizumi et al. | 345/102 |
| 8,483,479 | B2 * | 7/2013 | Kunkel et al. | 382/165 |
| 8,783,932 | B2 * | 7/2014 | Nishitani et al. | 362/613 |
| 2006/0232544 | A1 * | 10/2006 | Sakashita | 345/102 |
| 2006/0245209 | A1 | 11/2006 | Jeong et al. | |
| 2009/0040171 | A1 * | 2/2009 | Ishizumi et al. | 345/102 |
| 2009/0122030 | A1 * | 5/2009 | Morimoto et al. | 345/179 |
| 2009/0167655 | A1 * | 7/2009 | Ito et al. | 345/87 |
| 2011/0193896 | A1 * | 8/2011 | Johnson | 345/690 |
| 2012/0051635 | A1 * | 3/2012 | Kunkel et al. | 382/165 |
| 2013/0033901 | A1 | 2/2013 | Nishitani et al. | |

FOREIGN PATENT DOCUMENTS

| | | | |
|---|---|---|---|
| JP | 2011-228078 | A | 11/2011 |
| JP | 2011-258458 | A | 12/2011 |
| JP | 2012-238462 | A | 12/2012 |
| JP | 2012-252937 | A | 12/2012 |
| KR | 1020080043905 | A | 5/2008 |
| KR | 1020120134240 | A | 12/2012 |

* cited by examiner

*Primary Examiner* — Vijay Shankar
(74) *Attorney, Agent, or Firm* — Cantor Colburn LLP

(57) ABSTRACT

A display device includes a display panel configured to display an image corresponding to image data input thereto and be divided into a plurality of display blocks, a backlight unit configured to supply light to the display panel and including a light guide panel and a main light source module which supplies light to the light guide panel, and a luminance boosting unit configured to supply boosted light to the plurality of display blocks based on the image data and including a plurality of light source modules arranged to correspond to the plurality of display blocks, respectively.

20 Claims, 15 Drawing Sheets

DISPLAY DEVICE WITH LUMINANCE BOOSTING UNIT

This application claims priority to Korean Patent Application No. 10-2014-0032228, filed on Mar. 19, 2014, and all the benefits accruing therefrom under 35 U.S.C. §119, the disclosure of which is incorporated herein by reference in its entirety.

BACKGROUND

1. Field

Exemplary embodiments of the invention relate to a display device.

2. Description of the Related Art

As part of the effort to address the disadvantages of cathode ray tubes ("CRTs"), flat panel displays have been developed. Examples of the flat panel displays include liquid crystal displays ("LCDs"), organic light-emitting diode ("OLED") displays, and plasma display panels ("PDPs").

In the meantime, an LCD, which is a type of flat panel display, includes an LCD panel, which displays an image by using the optical transmittance of liquid crystal molecules, and a backlight assembly, which is disposed below the liquid crystal panel and provides light to the LCD panel.

The LCD panel includes an array substrate having plurality of pixel electrodes and a plurality of thin-film transistors ("TFTs") electrically connected to the plurality of pixel electrodes, a color filter substrate having a common electrode and a plurality of color filters, and a liquid crystal layer interposed between the array substrate and the color filter substrate.

The alignment of liquid crystal molecules in the liquid crystal layer varies in response to an electric field being formed between the plurality of pixel electrodes and the common electrode, and as a result, the transmissivity of light through the liquid crystal layer varies accordingly. When the transmissivity of light through the liquid crystal layer is maximized, the LCD panel may realize a high-luminance white image. When the transmissivity of light through the liquid crystal layer is minimized, the LCD panel may realize a low-luminance black image.

SUMMARY

It is generally difficult to uniformly align liquid crystal molecules in a liquid crystal layer in one direction, and a failure in the uniform alignment of the liquid crystal molecules in the liquid crystal layer may result in a decrease in the contrast ratio ("CR") of an image displayed on the liquid crystal display ("LCD") panel.

Exemplary embodiments of the invention provide improving the quality of images displayed by a display device having red pixels, green pixels and blue pixels.

However, exemplary embodiments of the invention are not restricted to those set forth herein. The above and other exemplary embodiments of the invention will become more apparent to one of ordinary skill in the art to which the invention pertains by referencing the detailed description of the invention given below.

According to an exemplary embodiment of the invention, there is provided a display device. The display device comprises a display panel configured to display an image corresponding to image data input thereto and be divided into a plurality of display blocks, a backlight unit configured to supply light to the display panel and including a light guide panel and a main light source module which supplies light to the light guide panel and a luminance boosting unit configured to supply boosted light to the plurality of display blocks based on the image data and including a plurality of light source modules arranged to correspond to the plurality of display blocks, respectively.

According to another exemplary embodiment of the invention, there is provided a display device. The display device comprises a display panel configured to display an image corresponding to image data input thereto and be divided into a plurality of display blocks, a backlight unit configured to supply light to the display panel and including a light guide panel and a main light source module which supplies light to the light guide panel and a luminance boosting unit configured to supply boosted light to the plurality of display blocks based on the image data and including a light source module, which emits light, and a plurality of micromirrors, which reflect light emitted from the light source module and thus transmit the light to the plurality of display blocks.

According to the invention, it is possible to improve the quality of images displayed by a display device having red pixels, green pixels and blue pixels.

Other features and exemplary embodiments will be apparent from the following detailed description, the drawings, and the claims.

BRIEF DESCRIPTION OF THE DRAWINGS

The above and other features and advantages of the invention will become more apparent by describing in detailed exemplary embodiments thereof with reference to the accompanying drawings, in which.

DETAILED DESCRIPTION

Figure 1A:
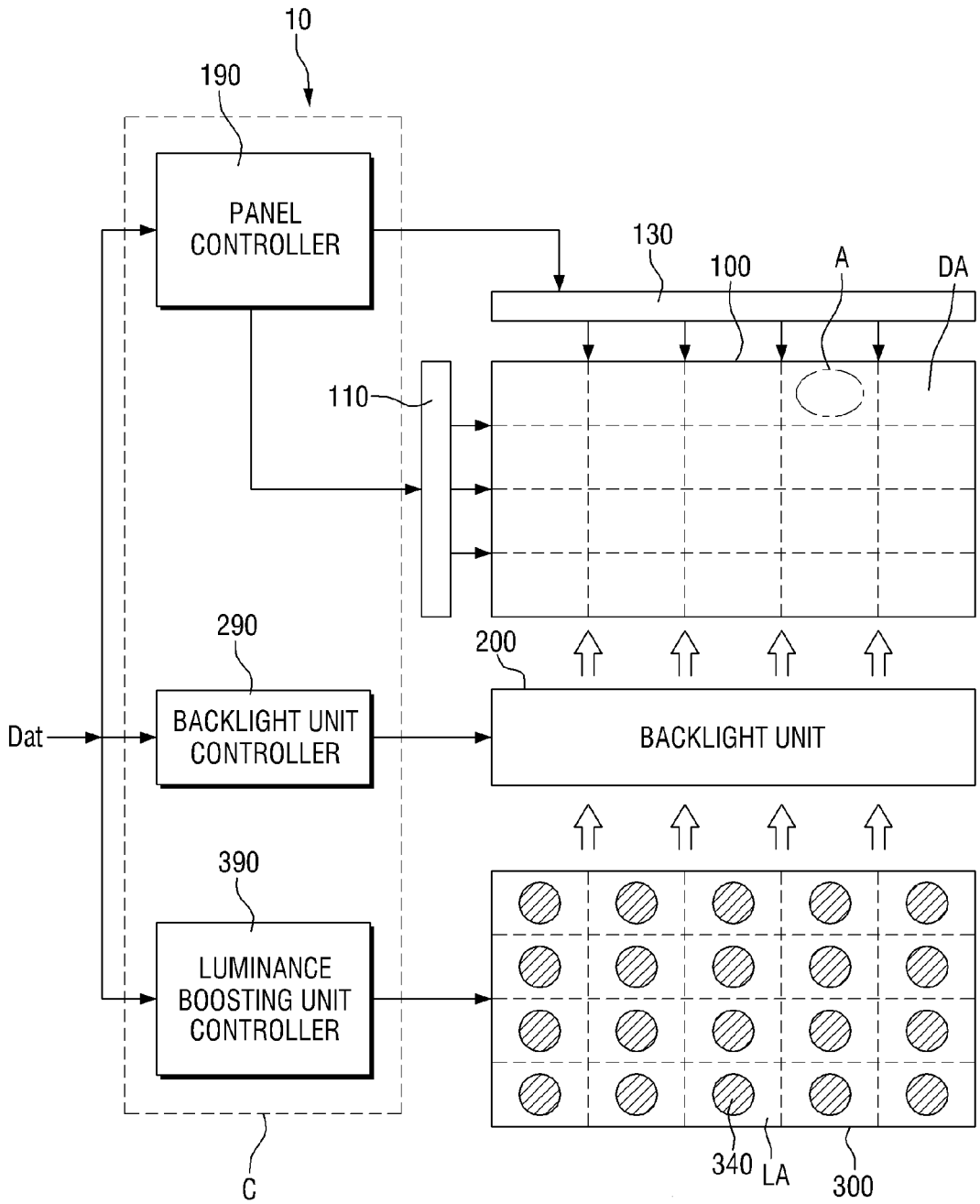
FIG. 1A is a block diagram and FIG. 1B is an enlarged view of an exemplary embodiment of a display device according to the invention.

Advantages and features of the invention and methods of accomplishing the same may be understood more readily by reference to the following detailed description of exemplary embodiments and the accompanying drawings. The invention may, however, be embodied in many different forms and should not be construed as being limited to the exemplary embodiments set forth herein. Rather, these exemplary embodiments are provided so that this invention will be thorough and complete and will fully convey the concept of the invention to those skilled in the art, and the invention will only be defined by the appended claims. Like numbers refer to like elements throughout. In the drawings, sizes and relative sizes of layers and regions may be exaggerated for clarity.

It will be understood that when an element or layer is referred to as being "on" another element or layer, it can be directly on the other element or layer or intervening elements or layers may be present.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. Like reference numerals refer to like elements throughout the specification.

Embodiments of the invention are described herein with reference to plan and cross-section illustrations that are schematic illustrations of idealized embodiments of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of the invention.

It will be understood that, although the terms first, second, third, etc., may be used herein to describe various elements, these elements should not be limited by these terms. These terms are only used to distinguish one element from another element. Thus, a first element discussed below could be termed a second element without departing from the teachings of the invention.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). The term, "about" can mean within one or more standard deviations, or within ±30%, 20%, 10%, 5% of the stated value, for example.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Hereinafter, embodiments of the invention will be described with reference to the attached drawings.

Figure 1B:
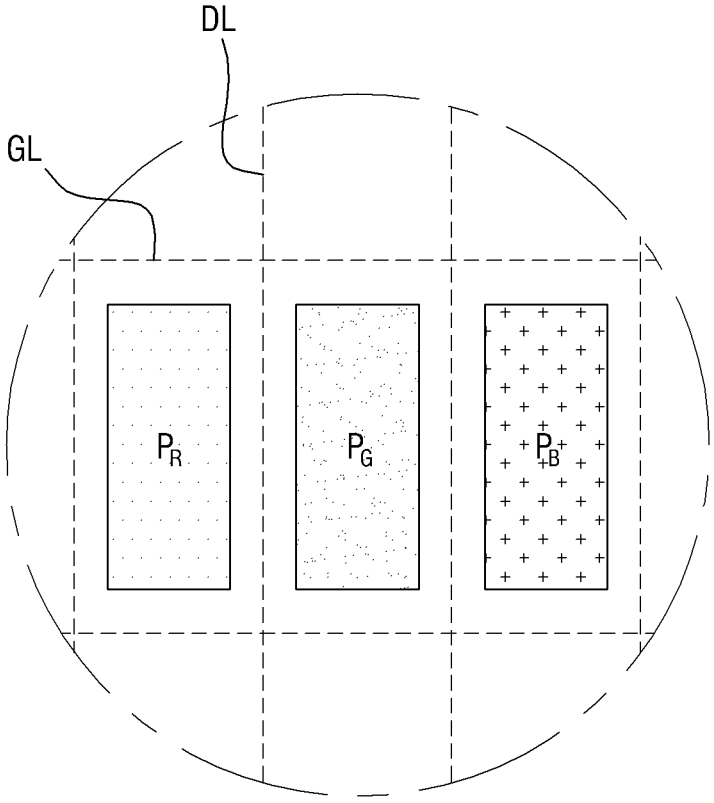
Figure 2:
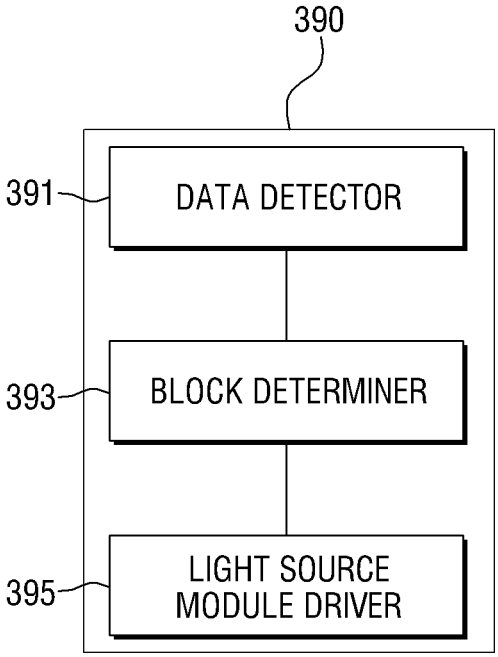
FIG. 2 is a block diagram of a luminance boosting unit controller illustrated in FIG. 1A.

FIG. 1A is a block diagram and FIG. 1B is an enlarged view of a display device according to an exemplary embodiment of the invention, and FIG. 2 is a block diagram of a luminance boosting unit controller illustrated in FIG. 1A.

Referring to FIGS. 1A and 1B, a display device 10 may include a display panel 100 which displays an image, a backlight unit 200 which supplies light to the display panel 100, a luminance boosting unit 300 which supplies boosted light to the display panel 100, and a control unit C which controls the general operation of the display device 10. The control unit C may include a panel controller 190 which controls the driving of the display panel 100, a backlight unit controller 290 which controls the driving of the backlight unit 200, and a luminance boosting unit controller 390 which controls the driving of the luminance boosting unit 300.

The display panel 100, which displays an image corresponding to image data Dat, may include a plurality of data lines DL, a plurality of gate lines GL which intersect the data lines DL, a plurality of pixels, and a gate driver 110 and a data driver 130 which applies a driving signal to the gate lines GL and the data lines DL. In an exemplary embodiment, the pixels may include a plurality of unit pixels such as red pixels $P_R$, green pixels $P_G$ and blue pixels $P_B$, but the invention is not limited thereto. That is, in other exemplary embodiments, the display panel 100 may also include unit pixels of other colors such as white, emerald or cyan, even though not specifically illustrated in the drawings. Each of the unit pixels may include a switching device, e.g., a thin film transistor ("TFT") (not illustrated), which is connected to one of the gate lines GL and one of the data lines DL, and a liquid crystal capacitor (not illustrated) and a storage capacitor (not illustrated), which are connected to the switching device. The display panel 100 may include a plurality of display blocks DA, and the number of display blocks DA may be m×n (where m and n are natural numbers). In an exemplary embodiment, the number of display blocks DA may be arranged in an m by n matrix.

When the image data Dat is input, the panel controller 190 may generate a panel driving signal for driving the display panel 100 based on the image data Dat. The panel driving signal may be transmitted to the gate driver 110 and the data driver 130 of the display panel 100, and may then be input to each of the pixels of the display panel 100 by the gate driver 110 and the data driver 130. In an exemplary embodiment, the panel driving signal may be input in units of frames or fields in synchronization with the frame period or field period of the image data Dat, but the invention is not limited thereto.

The backlight unit 200, which supplies light to the display panel 100, may include a light guide panel (not illustrated) which changes the path of light incident thereupon so that the incident light travels toward the display panel 100 and a main light source module (not illustrated) which supplies light to the light guide panel.

The backlight unit controller 290 may control the driving of the backlight unit 200 based on the image data Dat. More specifically, the backlight unit controller 290 may generate a backlight driving signal based on the image data Dat, and may control the turning on or off of the main light source module in accordance with the backlight driving signal. In an exemplary embodiment, the backlight driving signal may be input in synchronization with the input period of the panel driving signal, but the invention is not limited thereto. That is, the backlight driving signal may be input in units of frames or fields in synchronization with the frame period or field period of the image data Dat.

The luminance boosting unit 300, which supplies boosted light to the m×n display blocks DA of the display panel 100, may include m×n light source blocks LA corresponding to the m×n display blocks DA, respectively. The luminance boosting unit 300 may include a plurality of light source modules 340 which are disposed on a printed circuit board ("PCB") (not illustrated), and each of the m×n light source blocks LA may include at least one light source module 340. The light source modules 340 may include a first light source emitting light of a first color, a second light source emitting light of a second color, which is different from the first color, and a third light source emitting light of a third color, which is different from the first color and the second color. In an exemplary embodiment, the first color, the second color and the third color may be red, green and blue, respectively.

The luminance boosting unit controller 390 may control the driving of the luminance boosting unit 300 based on the image data Dat. More specifically, the luminance boosting unit controller 390 may control the driving of the light source modules 340 in units of the display blocks DA based on the image data Dat.

As illustrated in FIGS. 1 and 2, the luminance boosting unit controller 390 may include a data detector 391, a block determiner 393 and a light source module driver 395. In an exemplary embodiment, the data detector 391 may detect block image data corresponding to each of the display blocks DA from the image data Dat. In an exemplary embodiment, the block image data may be representative luminance data of an image displayed in each of the display blocks DA, and the representative luminance data may be average luminance data, maximum luminance data or minimum luminance data of the image displayed in each of the display blocks DA. In an alternative exemplary embodiment, the block image data may be gray-scale data or color purity data of the image displayed in each of the display blocks DA. In a non-limiting exemplary embodiment, the image data Dat may be converted into image data of individual colors, for example, red image data, green image data and blue image data, and the block image data may be detected from each of the individual color image data.

The block determiner 393 may determine one or more target display blocks DA to which boosted light is to be supplied based on the block image data. In an exemplary embodiment, the block determiner 393 may compare the block image data with predetermined reference data, may determine one or more target display blocks DA based on the results of the comparison, and may generate a light source module driving signal.

More specifically, the block determiner 393 may compare the block image data detected by the data detector 391 with the reference data, and may determine one or more display blocks DA corresponding to block image data exceeding the reference data as target display blocks DA, and may generate a light source module driving signal for driving the light source modules 340 of the target display blocks DA. In an exemplary embodiment, the reference data may include data relating to a reference luminance level or color purity level, for example, that can be provided by the display device 10, and the block image data may include luminance data or color purity data of each of the display blocks DA. In an exemplary embodiment, in a case in which an image displayed in a particular display block DA has a luminance or color purity level that cannot be displayed by the display device 10, the block determiner 393 may determine the particular display block DA as a target display block DA to which boosted light is to be supplied, but the invention is not limited thereto. That is, in other exemplary embodiments, the block determiner 393 may determine one or more target display blocks DA in various manners, other than that set forth herein.

The light source module driver 395 may drive the light source modules 340 in accordance with the light source module driving signal applied thereto by the block determiner 393, and as a result, the light source modules 340 may be driven individually so as to selectively supply boosted light to the display blocks DA of the display panel 100.

Figure 3:
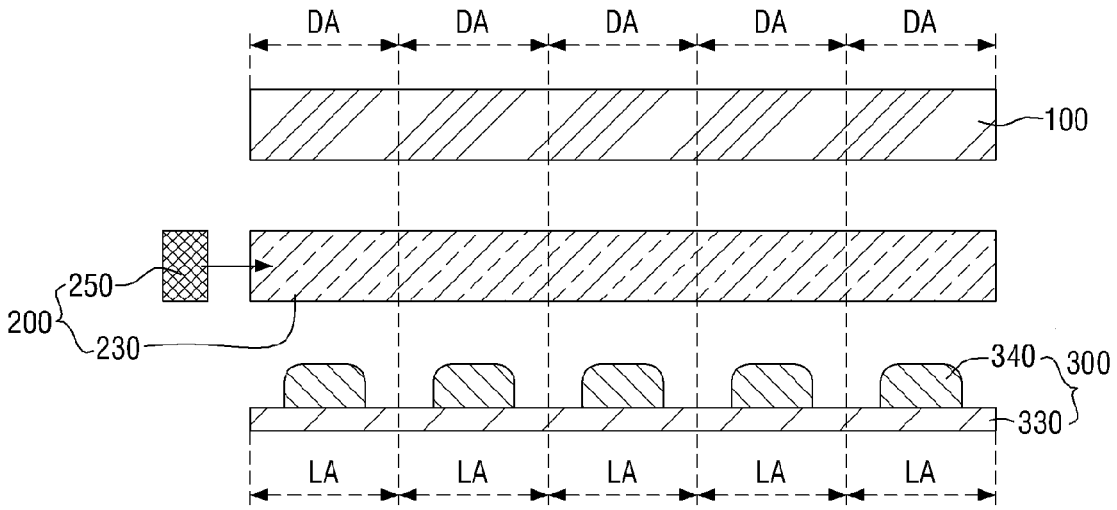
FIG. 3 is a schematic cross-sectional view of the display device illustrated in FIG. 1A.
Figure 4:
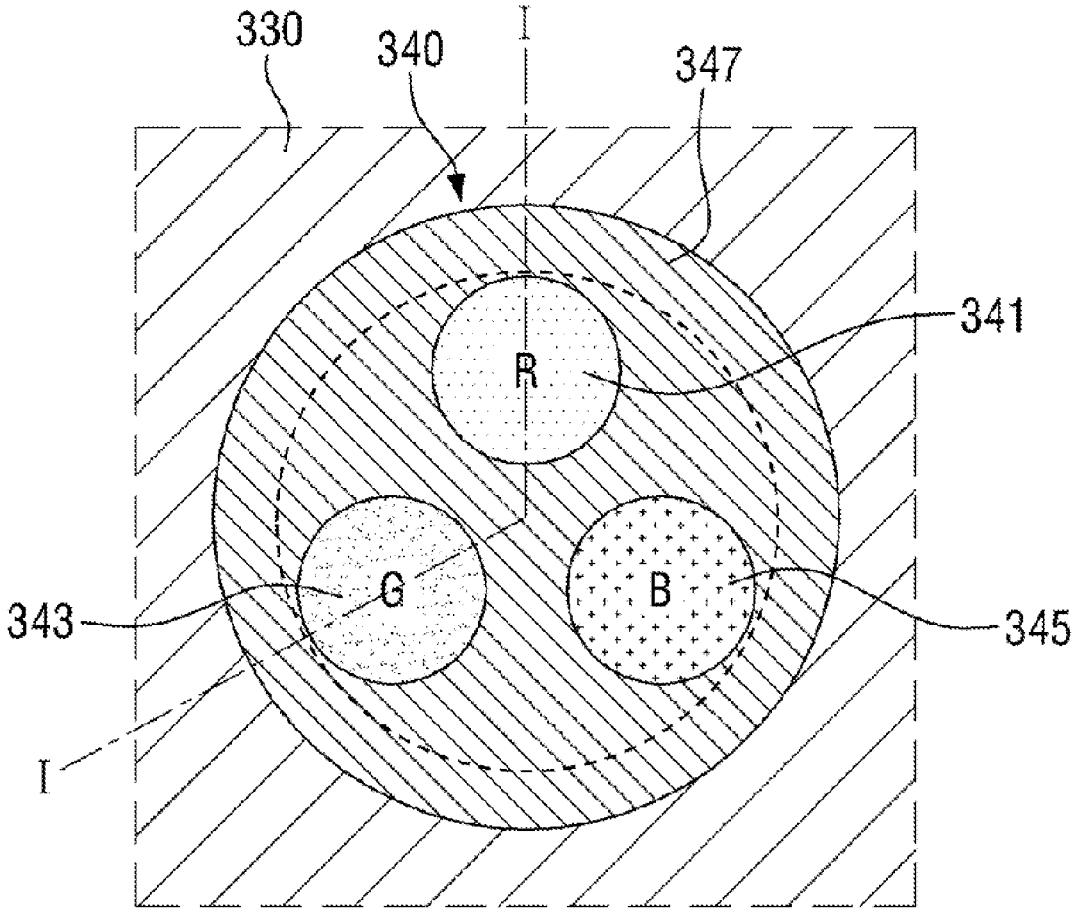
FIG. 4 is a plan view of a light source module illustrated in FIG. 3.
Figure 5:
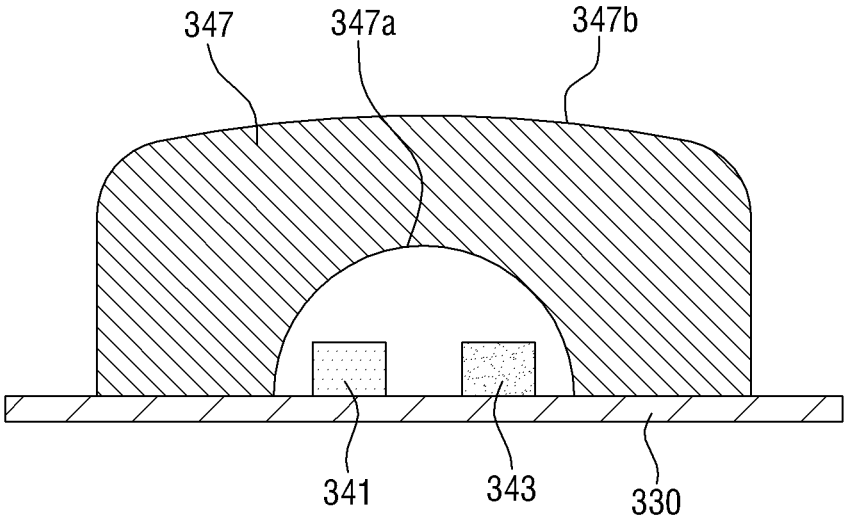
FIG. 5 is a cross-sectional view of the light source module illustrated in FIG. 4 taken along line I-I.

FIG. 3 is a schematic cross-sectional view of the display device 10, FIG. 4 is a plan view of a light source module illustrated in FIG. 3, and FIG. 5 is a cross-sectional view of the light source module illustrated in FIG. 4.

Referring to FIG. 3, the backlight unit 200 may be disposed below the display panel 100 including the display blocks DA, and the luminance boosting unit 300 may be disposed below the backlight unit 200. The luminance boosting unit 300 may include the light source blocks LA, which correspond to the display blocks DA, respectively.

The backlight unit 200 may include a light guide panel 230 and a main light source module 250.

The light guide panel 230 may guide light emitted or supplied from the light source module 250. In an exemplary embodiment, the light guide panel 230 may include a transparent material, and may guide light supplied from the light source module 250 toward the display panel 100, which is disposed above the light guide panel 230. Various patterns may be printed on a rear surface of the light guide panel 230 facing the luminance boosting unit 300 for changing the path of light incident upon the light guide panel 230 so that the incident light may travel toward the display panel 100. In an exemplary embodiment, the light guide panel 230 may include an acrylic material, for example, polymethyl methacrylate ("PMMA"), but the invention is not limited thereto.

The main light source module 250 may be disposed on one side of the light guide panel 230, and may provide light to the display panel 100. The main light source module 250 may include one or more light sources and a PCB on which the light sources are mounted. In an exemplary embodiment, the light sources may include white light-emitting diodes ("LEDs"), for example, but the invention is not limited thereto. In an alternative exemplary embodiment, the light sources may include red, green and blue LEDs, or may include cold cathode fluorescent lamps ("CCFLs"), for example.

The luminance boosting unit 300 may be disposed below the backlight unit 200. The luminance boosting unit 300 may include a PCB 330 and the light source modules 340, which are disposed on the PCB 330.

The PCB 330 may support the light source modules 340, and may transmit a voltage for driving the light source modules 340 to the light source modules 340. In an exemplary embodiment, for efficient heat dissipation, a metal core PCB may be used as the PCB 330, but the invention is not limited thereto.

The light source modules 340, which supply boosted light to the display blocks DA, may be disposed in the light source blocks LA, respectively, and the light source blocks LA correspond to the display blocks DA, respectively. As illustrated in FIGS. 4 and 5, each of the light source modules 340 may include a first light source 341 emitting light of a first color, a second light source 343 emitting light of a second color, which is different from the first color, and a third light source 345 emitting light of a third color, which is different from the first color and the second color. In an exemplary embodiment, the first color, the second color and the third color may be red, green and blue, respectively, for example. That is, in the illustrated exemplary embodiment, the first light source 341, the second light source 343 and the third light source 345 may be a red light source, a green light source and a blue light source, respectively.

The first light source 341, the second light source 343 and the third light source 345 may be driven individually by the luminance boosting unit controller 390 of FIG. 1A, e.g., the light source module driver 395 of the luminance boosting unit controller 390 of FIG. 2, and brightnesses of the first light source 341, the second light source 343 and the third light source 345 may be adjusted individually. In an exemplary embodiment, only the first light source 341 may be driven to emit red light, only the second light source 343 may be driven to emit green light, or only the third light source 345 may be driven to emit blue light. In the exemplary embodiment, the brightnesses of the red light, the green light and the blue light may be adjusted individually. However, the invention is not limited to the exemplary embodiment. That is, two or more of the first light source 341, the second light source 343 and the third light source 345 may be driven at the same time, and brightnesses of the first light source 341, the second light source 343 and the third light source 345 may be adjusted individually, thereby emitting a variety of mixed light.

In an exemplary embodiment, the first light source 341, the second light source 343 and the third light source 345 may be laser diodes, for example. In an exemplary embodiment, the first light source 341, the second light source 343 and the third light source 345 may be a red laser diode, a green laser diode and a blue laser diode, respectively. In a case in which the first light source 341, the second light source 343 and the third light source 345 are laser diodes, the first light source 341, the second light source 343 and the third light source 345 may be able to emit light with a narrow radiation angle, and thus improving the color purity or color reproducibility of an image, but the invention is not limited thereto. That is, in other exemplary embodiments, the first light source 341, the second light source 343 and the third light source 345 may be LEDs, for example. In an exemplary embodiment, the first light source 341, the second light source 343 and the third light source 345 may be a red LED, a green LED and a blue LED, respectively, for example.

Each of the light source modules 340 may also include a light diffuser 347 which diffuses light emitted from the first light source 341, the second light source 343 and/or the third light source 345. In an exemplary embodiment, the light diffuser 347 may be a diffusing lens provided to cover the first light source 341, the second light source 343 and the third light source 345, for example.

The diffusing lens, which is an optical member for diffusing light emitted from the first light source 341, the second light source 343 and/or the third light source 345 so that the light is emitted outward, may include an inner curved surface 347*a* and an outer curved surface 347*b*, which are elliptic surfaces, to effectively scatter light emitted from the first light source 341, the second light source 343 and/or the third light source 345. An ellipse is defined as a set of points in a plane such that a sum of a distance from two fixed points remains constant, and the two fixed points are referred to as focal points. In the ellipse, a straight line drawn between the two focal points may be defined as a major axis, and the axis passing through the center of the ellipse and perpendicular to the major axis is defined as a minor axis.

The major axis is longer than the minor axis. By rotating the ellipse with reference to the major axis or the minor axis, an elliptic surface may be obtained.

In an exemplary embodiment, the inner curved surface 347*a* and the outer curved surface 347*b* of the diffusing lens of the light diffuser 347 may be formed as elliptic surfaces having their major axes perpendicular to each other. In an exemplary embodiment, when the major axis of the inner curved surface 347*a* extends in a vertical direction, the major axis of the outer curved surface 347*b* may extend in a horizontal direction. When the major axes of the inner curved surface 347*a* and the outer curved surface 347*b* perpendicularly intersect each other, the thickness of the light diffuser 347 measured in a vertical direction in a cross-section, i.e., the vertical distance between the inner curved surface 347*a* and the outer curved surface 347*b*, may vary from one portion to another portion of the light diffuser 347. Therefore, differences in the path of light transmitted through the light diffuser 347 may be caused due to the varying thickness of the light diffuser 347, and as a result, light may be properly diffused by the light diffuser 347.

Figure 6:
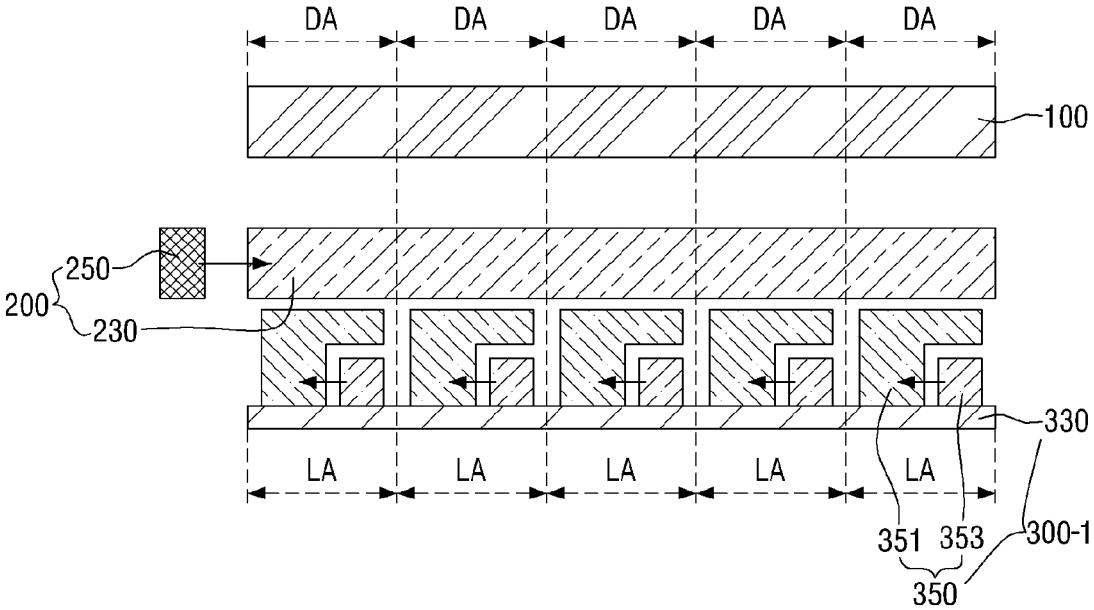
FIG. 6 is a schematic cross-sectional view of another exemplary embodiment of a display device according to the invention.
Figure 7:
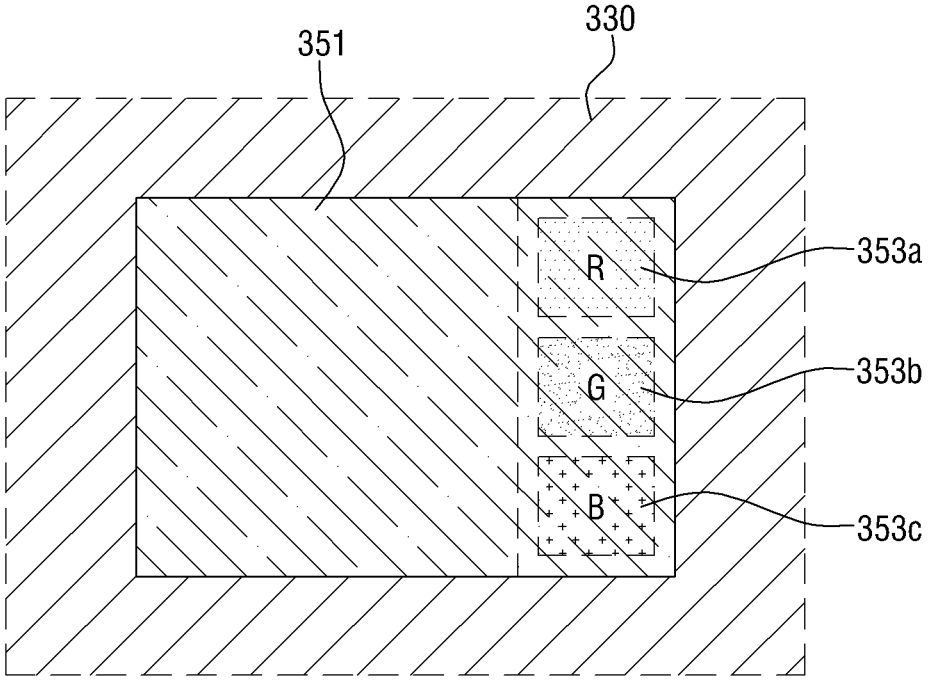
FIG. 7 is a plan view of a light source module illustrated in FIG. 6.

FIG. 6 is a schematic cross-sectional view of a display device according to another exemplary embodiment of the invention, and FIG. 7 is a plan view of a light source module illustrated in FIG. 6.

The display device of FIG. 6 is the same as the display device of FIG. 3 except that it includes a luminance boosting unit 300-1, which is different from the luminance boosting unit 300 of FIG. 3. Accordingly, the display device of FIG. 6 will hereinafter be described, focusing mainly on differences from the display device of FIG. 3.

Referring to FIGS. 6 and 7, the luminance boosting unit 300-1 may be disposed below a backlight unit 200, and may include a PCB 330 and a plurality of light source modules 350 disposed on the PCB 330.

The PCB 330 may support the light source modules 350, and may transmit a voltage for driving the light source modules 350 to the light source modules 350. In an exemplary embodiment, for efficient heat dissipation, a metal core PCB may be used as the PCB 330, for example, but the invention is not limited thereto.

The light source modules 350, which supply boosted light to a plurality of display blocks DA, may be disposed in a plurality of light source blocks LA, respectively, and the light source blocks LA may correspond to the display blocks DA, respectively.

Each of the light source modules 350 may include a light source 353 and an auxiliary light guide panel 351, which diffuses light emitted from the light source 353. The light source 353 may be disposed adjacent to one side of the auxiliary light guide panel 351.

The auxiliary light guide panel 351 may guide light emitted or supplied from the light source 353 toward a display block DA or a part of a light guide panel 230 corresponding to the display block DA. In an exemplary embodiment, the auxiliary light guide panel 351 may include a transparent material, for example. Various patterns may be printed on the rear surface of the auxiliary light guide panel 351 for changing the path of light incident upon the auxiliary light guide panel 351 so that the incident light travels toward the light guide panel 230 or the display block DA. In an exemplary embodiment, the auxiliary light guide panel 351 may include an acrylic material, for example, PMMA, but the invention is not limited thereto.

As illustrated in FIG. 6, the auxiliary light guide panels 351 of the light source modules 350 may be disposed on a level with one another to not overlap one another. That is, the auxiliary light guide panels 351 of the light source modules 350 may be arranged as tiles. Referring further to FIG. 7, a recess may be defined in one side of the auxiliary light guide panel 351, and the light source 353 may be disposed in the recess.

More specifically, the light source 353 may be disposed in the recess in one side of the auxiliary light guide panel 351. The light source 353 may emit light toward one side of the auxiliary light guide panel 351. The light source 353 may include a first light source 353*a* emitting light of a first color, a second light source 353*b* emitting light of a second color, which is different from the first color, and a third light source 353*c* emitting light of a third color, which is different from the first color and the second color. In an exemplary embodiment, the first color, the second color and the third color may be red, green and blue, respectively, for example. That is, in the illustrated exemplary embodiment, the first light source 353*a*, the second light source 353*b* and the third light source 353*c* may be a red light source, a green light source and a blue light source, respectively, for example.

The first light source 353*a*, the second light source 353*b* and the third light source 353*c*, like the first light source 341, the second light source 343 and the third light source 345 of FIG. 4, may be driven individually by the luminance boosting unit controller 390 of FIG. 1A, e.g., the light source module driver 395 of the luminance boosting unit controller 390 of FIG. 2, and their brightnesses may be adjusted individually.

In an exemplary embodiment, the first light source 353*a*, the second light source 353*b* and the third light source 353*c* may be laser diodes. In an exemplary embodiment, the first light source 353*a*, the second light source 353*b* and the third light source 353*c* may be a red laser diode, a green laser diode and a blue laser diode, respectively, but the invention is not limited thereto. That is, in other exemplary embodiments, the first light source 353*a*, the second light source 353*b* and the third light source 353*c* may be LEDs. In an exemplary embodiment, the first light source 353*a*, the second light source 353*b* and the third light source 353*c* may be a red LED, a green LED and a blue LED, respectively, for example.

Figure 8:
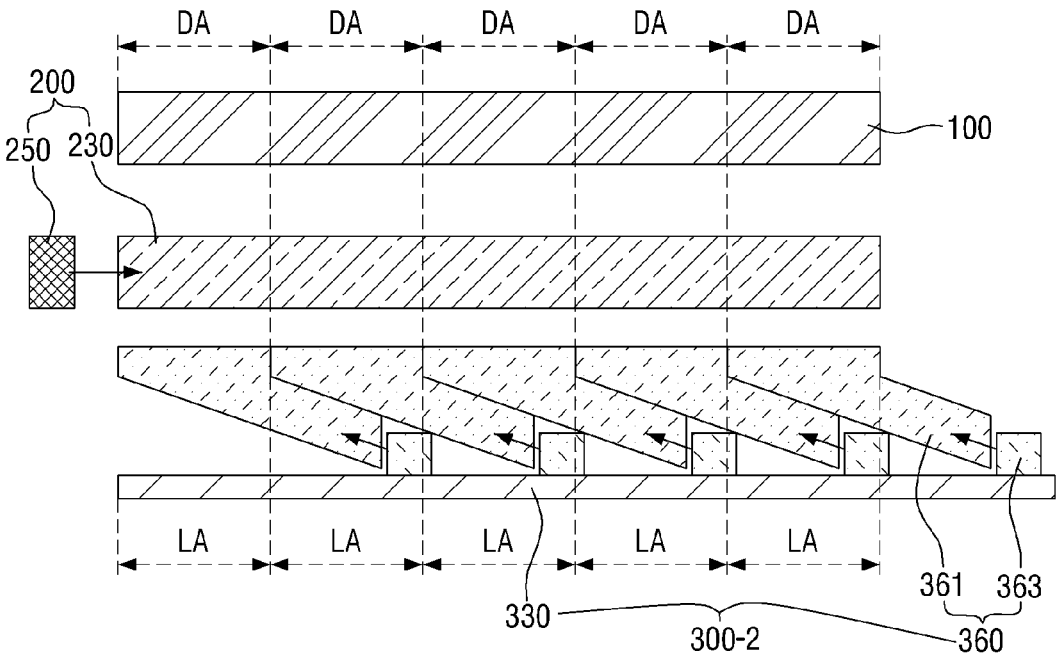
FIG. 8 is a schematic cross-sectional view of another exemplary embodiment of a display device according to the invention.
Figure 9:
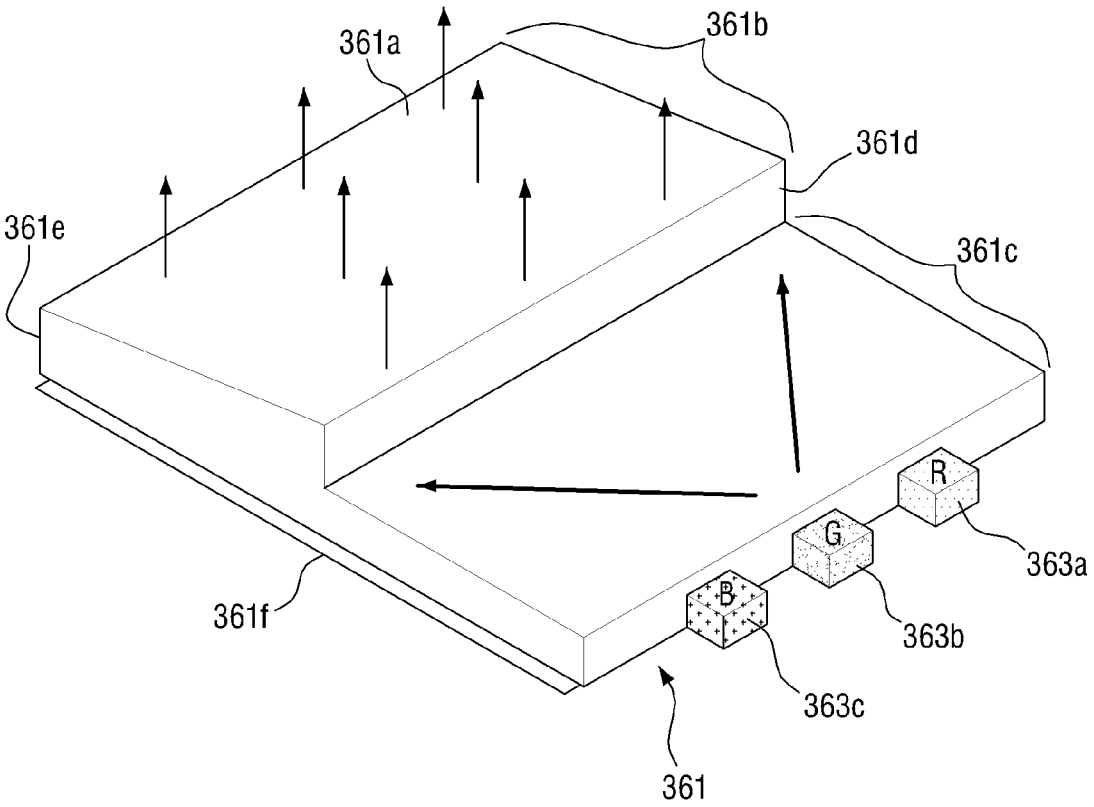
FIG. 9 is an enlarged perspective view of a light source module illustrated in FIG. 8.

FIG. 8 is a schematic cross-sectional view of a display device according to another exemplary embodiment of the invention, and FIG. 9 is a perspective view of a light source module illustrated in FIG. 8. The display device of FIG. 8 is the same as the display device of FIG. 3 or 6 except that it includes a luminance boosting unit 300-2, which is different from the luminance boosting unit 300 of FIG. 3 and the luminance boosting unit 300-1 of FIG. 6. Accordingly, the display device of FIG. 8 will hereinafter be described, focusing mainly on differences from the display device of FIG. 3 and the display device of FIG. 6.

Referring to FIGS. 8 and 9, the luminance boosting unit 300-2 may be disposed below a backlight unit 200, and may include a PCB 330 and a plurality of light source modules 360 disposed on the PCB 330.

The light source modules 360, which supply boosted light to a plurality of display blocks DA, may be disposed to overlap a plurality of light source blocks LA corresponding to the display blocks DA, respectively.

Each of the light source modules 360 may include a light source 363 and an auxiliary light guide panel 361, which diffuses light emitted from the light source 363. The light source 363 may be disposed on one side of the auxiliary light guide panel 361.

The light source 363 may include a first light source 363*a* emitting light of a first color, a second light source 363*b* emitting light of a second color, which is different from the first color, and a third light source 363*c* emitting light of a third color, which is different from the first color and the second color. In an exemplary embodiment, the first color, the second color and the third color may be red, green and blue, respectively, for example. That is, in an exemplary embodiment, the first light source 363*a*, the second light source 363*b* and the third light source 363*c* may be a red light source, a green light source and a blue light source, respectively, for example. The light source 363 is the same as its counterparts in FIGS. 3, 6 and 7, and thus, a detailed description thereof will be omitted.

The auxiliary light guide panel 361 may guide light emitted or supplied from the light source 363 toward a display block DA or part of a light guide panel 230 corresponding to the display block DA. The auxiliary light guide panel 361 may include a transparent material. Various patterns may be printed on a rear surface of the auxiliary light guide panel 361 facing the PCB 330 for changing the path of light incident upon the auxiliary light guide panel 361 so that the incident light travels toward the light guide panel 230 or the display block DA, and a reflective sheet 361*f* may be additionally provided, when necessary. In an exemplary embodiment, the auxiliary light guide panel 361 may include an acrylic material, for example, PMMA, but the invention is not limited thereto.

As illustrated in FIG. 8, the auxiliary light guide panels 361 of the light source modules 360 may be disposed to overlap one another. As illustrated in FIG. 9, the auxiliary light guide panel 361 may include an emission portion 361*b* having an emission surface 361*a* through which light is emitted and a light guide portion 361*c* guiding light emitted from the light source 363. The auxiliary light guide panels 361 of the light source modules 361 may be disposed in such a manner that the emission portions 361*b* of the auxiliary light guide panels 361 of the light source modules 360 correspond to the display blocks DA, respectively. The first light source 363*a*, the second light source 363*b* and the third light source 363*c* may be disposed on one side of the corresponding light guide portion 361*c*. Referring further to FIG. 9, a stepped portion 361*d* may be provided between, and connect, the emission portion 361*b* and the light guide portion 361*c*. That is, the thickness of the auxiliary light guide panel 361 at the emission portion 361*b* may differ from the thickness of the auxiliary light guide panel 361 at the light guide portion 361*c*. In FIG. 9, reference numeral 361*e* denotes the distal side of the auxiliary light guide panel 361 from the light source 363. The light guide portion 361*c* of an auxiliary light guide panel 361 may overlap the emission portion 361*b* of a neighboring auxiliary light guide panel 361. The stepped portion 361*d* of an auxiliary light guide panel 361 may face the distal side 361*e* of a neighboring auxiliary light guide panel 361. According to this type of configuration of the auxiliary light guide panels 361 of the light source modules 360, it is possible to uniformly supply light from the light sources 363 of the light source modules to the display blocks DA.

Figure 10A:
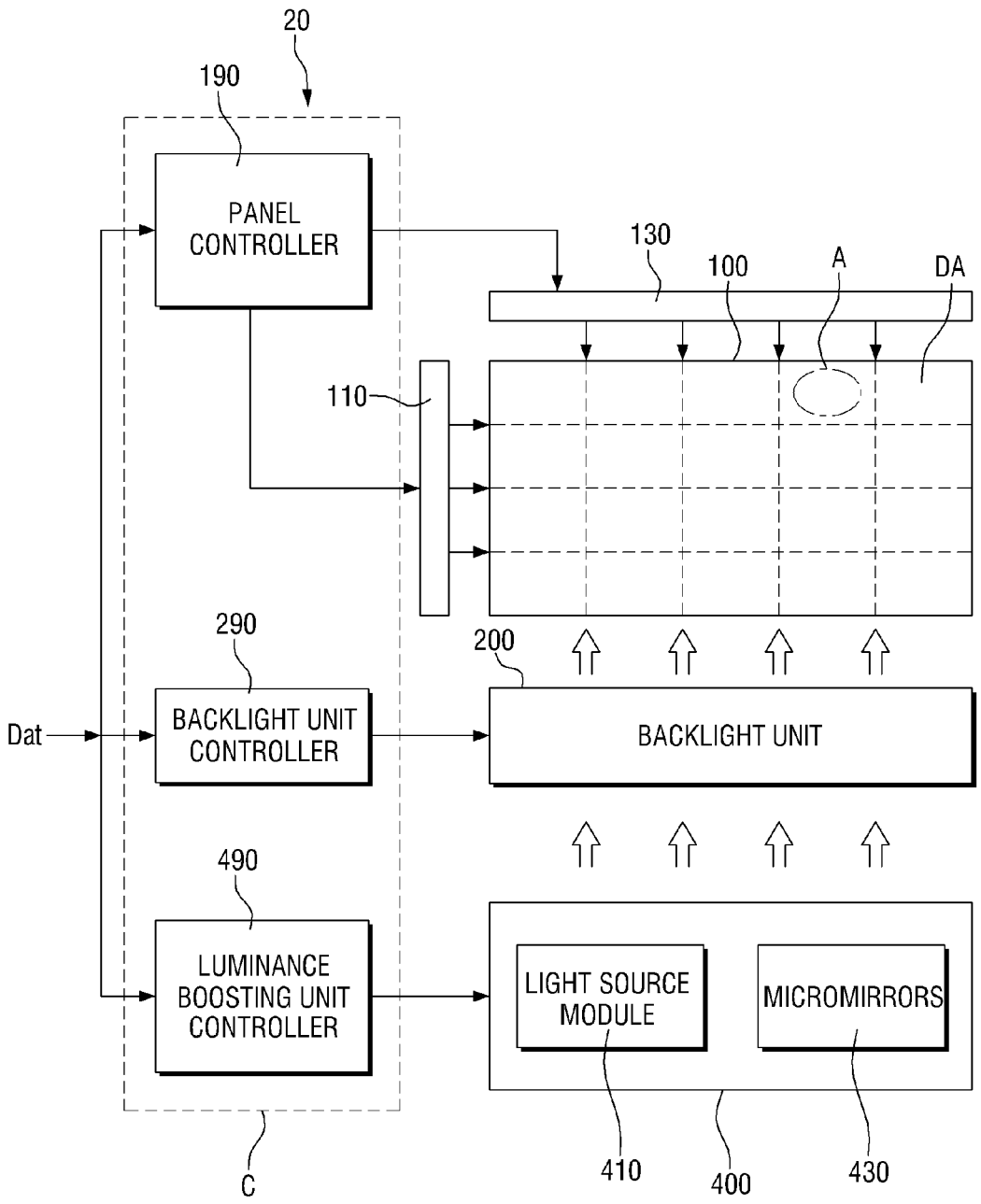
FIG. 10A is a block diagram and FIG. 10B is an enlarged view of another exemplary embodiment of a display device according to the invention.
Figure 10B:
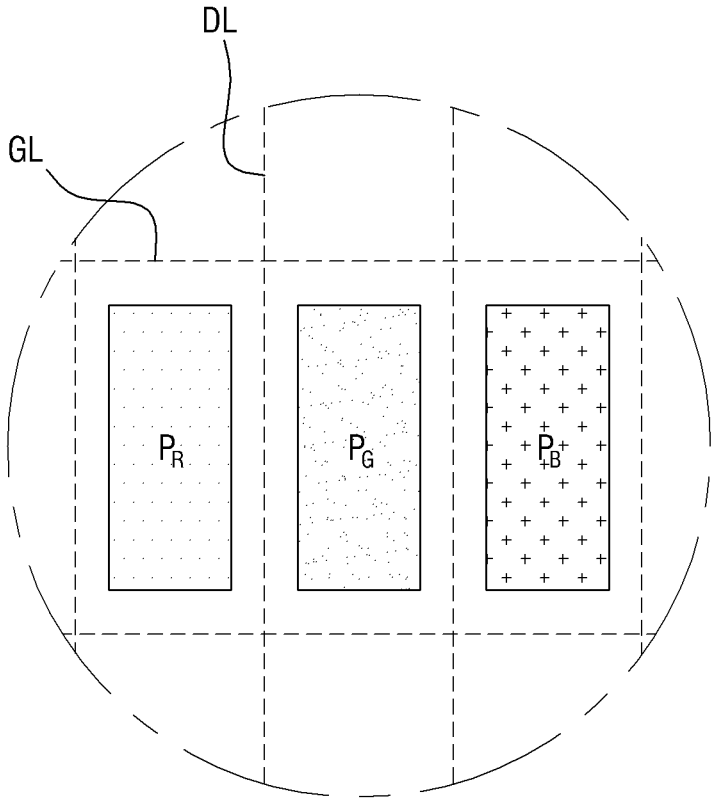
Figure 11:
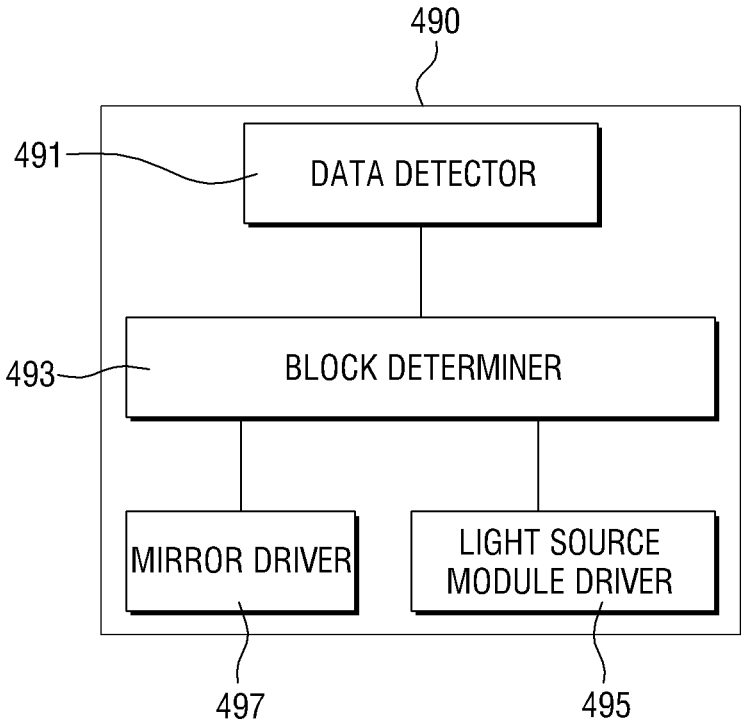
FIG. 11 is a block diagram of a luminance boosting unit controller illustrated in FIG. 10A.
Figure 12:
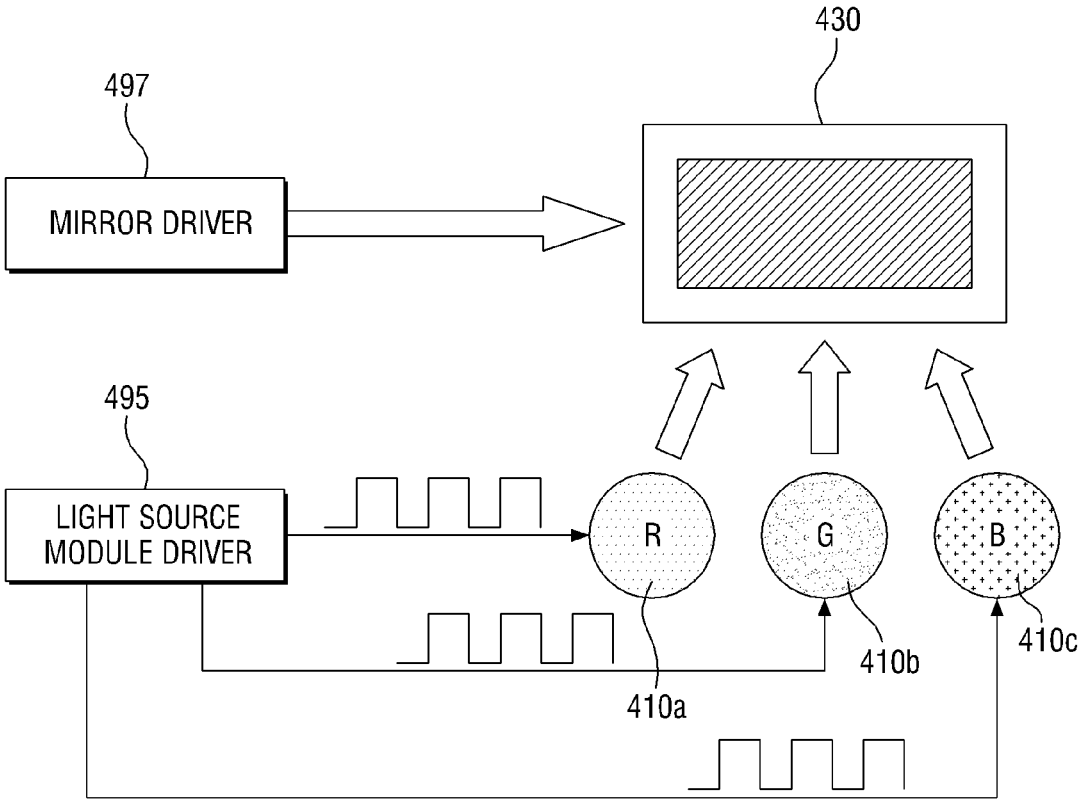
FIG. 12 is a block diagram of another exemplary embodiment of a display device according to the invention.

FIG. 10A is a block diagram and FIG. 10B is an enlarged view of a display device according to another exemplary embodiment of the invention, FIG. 11 is a block diagram of a luminance boosting unit controller illustrated in FIG. 10A, and FIG. 12 is a block diagram of a display device according to another exemplary embodiment of the invention.

A display device 20 of FIGS. 10 to 12 is the same as the display device 10 of FIGS. 1 and 2 except that it includes a luminance boosting unit 400 and a luminance boosting unit controller 490 that are different from the luminance boosting unit 300 and the luminance boosting unit controller 390, respectively, of FIGS. 1 and 2. Accordingly, the display device 20 will hereinafter be described, focusing mainly on differences from the display device 10.

Referring to FIGS. 10A and 10B, the display device 20 may include a display panel 100 which displays an image, a backlight unit 200 which supplies light to the display panel 100, the luminance boosting unit 400 which supplies boosted light to the display panel 100, and a control unit C which controls the general operation of the display device 20. The control unit C may include a panel controller 190 which controls the driving of the display panel 100, a backlight unit controller 290 which controls the driving of the backlight unit 200, and the luminance boosting unit controller 490 which controls the driving of the luminance boosting unit 400.

The display panel 100, which displays an image corresponding to image data Dat, may include a plurality of display blocks DA, and the number of display blocks DA may be m×n (where m and n are natural numbers). In an exemplary embodiment, the number of display blocks DA may be arranged in an m by n matrix.

The luminance boosting unit 400, which supplies boosted light to the display blocks DA of the display panel 100, may include a light source module 410 and a plurality of micromirrors 430.

As illustrated in FIG. 12, the light source module 410 may include a first light source 410*a* emitting light of a first color, a second light source 410*b* emitting light of a second color, which is different from the first color, and a third light source 410*c* emitting light of a third color, which is different from the first color and the second color. In an exemplary embodiment, the first color, the second color and the third color may be red, green and blue, respectively, for example.

In an exemplary embodiment, the first light source 410*a*, the second light source 410*b* and the third light source 410*c* may be laser diodes, for example. In an exemplary embodiment, the first light source 410*a*, the second light source 410*b* and the third light source 410*c* may be a red laser diode, a green laser diode and a blue laser diode, respectively, for example. When the first light source 410*a*, the second light source 410*b* and the third light source 410*c* are laser diodes, the first light source 410*a*, the second light source 410*b* and the third light source 410*c* may be able to emit light with a narrow radiation angle, and thus improving the color purity or color reproducibility of an image, but the invention is not limited thereto. That is, in other exemplary embodiments, the first light source 410*a*, the second light source 410*b* and the third light source 410*c* may be LEDs, for example. In an exemplary embodiment, the first light source 410*a*, the second light source 410*b* and the third light source 410*c* may be a red LED, a green LED and a blue LED, respectively, for example.

The micromirrors 430 may reflect light provided by the light source module 410 so as to transmit the light to the display blocks DA. The number of micromirrors 430 may be the same as the number of display blocks DA. In an exemplary embodiment, when there are m×n display blocks DA, m×n micromirrors 430 may be provided, but the invention is not limited thereto. That is, in other exemplary embodiments, the number of micromirrors 430 may be appropriately determined.

In an exemplary embodiment, the micromirrors 430 may be implemented as digital micromirror devices ("DMDs"), for example, which are optical devices widely used in various fields. A DMD chip has on its surface numerous micromirrors arranged in an array. The reflection angle of micromirrors 430 may be adjusted in accordance with a mirror driving signal.

The luminance boosting unit controller 490 may control the driving of the luminance boosting unit 400 based on the image data Dat. More specifically, the luminance boosting unit controller 490 may control the driving of the light source module 410 corresponding to the display blocks DA based on the image data Dat.

As illustrated in FIGS. 10 to 12, the luminance boosting unit controller 490 may include a data detector 491, a block determiner 493, a light source module driver 495 and a mirror driver 497. In an exemplary embodiment, the data detector 491 may detect block image data corresponding to each of the display blocks DA from the image data Dat. In an exemplary embodiment, the block image data may be representative luminance data of an image displayed in each of the display blocks DA, and the representative luminance data may be average luminance data, maximum luminance data or minimum luminance data of the image displayed in each of the display blocks DA, for example. In an alternative exemplary embodiment, the block image data may be gray-scale data or color purity data of the image displayed in each of the display blocks DA, for example. In a non-limiting exemplary embodiment, the image data Dat may be converted into image data of individual colors, for example, red image data, green image data and blue image data, and the block image data may be detected from each of the individual color image data.

The block determiner 493 may determine one or more target display blocks DA to which boosted light is to be supplied based on the block image data. In an exemplary embodiment, the block determiner 493 may compare the block image data with predetermined reference data, may determine one or more target display blocks DA based on the results of the comparison, and may generate a light source module driving signal and a mirror driving signal.

More specifically, the block determiner 493 may compare the block image data detected by the data detector 491 with the reference data, and may determine one or more display blocks DA corresponding to block image data exceeding the reference data as target display blocks DA, and may generate a mirror driving signal for driving micromirrors 430 corresponding to the target display blocks DA and a light source module driving signal for driving the light source module 410. In an exemplary embodiment, the reference data may include data relating to a reference luminance level or color purity level that can be provided by the display device 20, and the block image data may include luminance data or color purity data of each of the display blocks DA, for example. In an exemplary embodiment, in a case in which an image displayed in a particular display block DA has a luminance or color purity level that cannot be provided by the display device 20, the block determiner 493 may determine the particular display block DA as a target display block DA to which boosted light is to be supplied, but the invention is not limited thereto. That is, in other exemplary embodiments, the block determiner 493 may determine one or more target display blocks DA in various manners, other than that set forth herein.

The light source module driver 495 may drive the light source module 410 in accordance with the light source module driving signal applied thereto by the block determiner 493. The light source module driver 495 may drive the first light source 410*a*, the second light source 410*b* and the third light source 410*c* of the light source module 410 individually or sequentially, or may drive two or more of the first light source 410*a*, the second light source 410*b* and the third light source 410*c* at the same time.

The mirror driver 497 may drive the micromirrors 430 in accordance with the mirror driving signal applied thereto by the block determiner 493. The mirror driving signal may be synchronized with the light source module driving signal, and the micromirrors 430 may be driven to correspond to the operation of the light source module 410. That is, to supply red light to a particular display block DA, the light source module driver 495 may drive only the first light source 410*a*, which emits red light, and the mirror driver 497 may adjust the reflection angle of a micromirror 430 corresponding to the particular display block DA so that the red light emitted from the first light source 410*a* can be provided to the particular display block DA.

Figure 13:
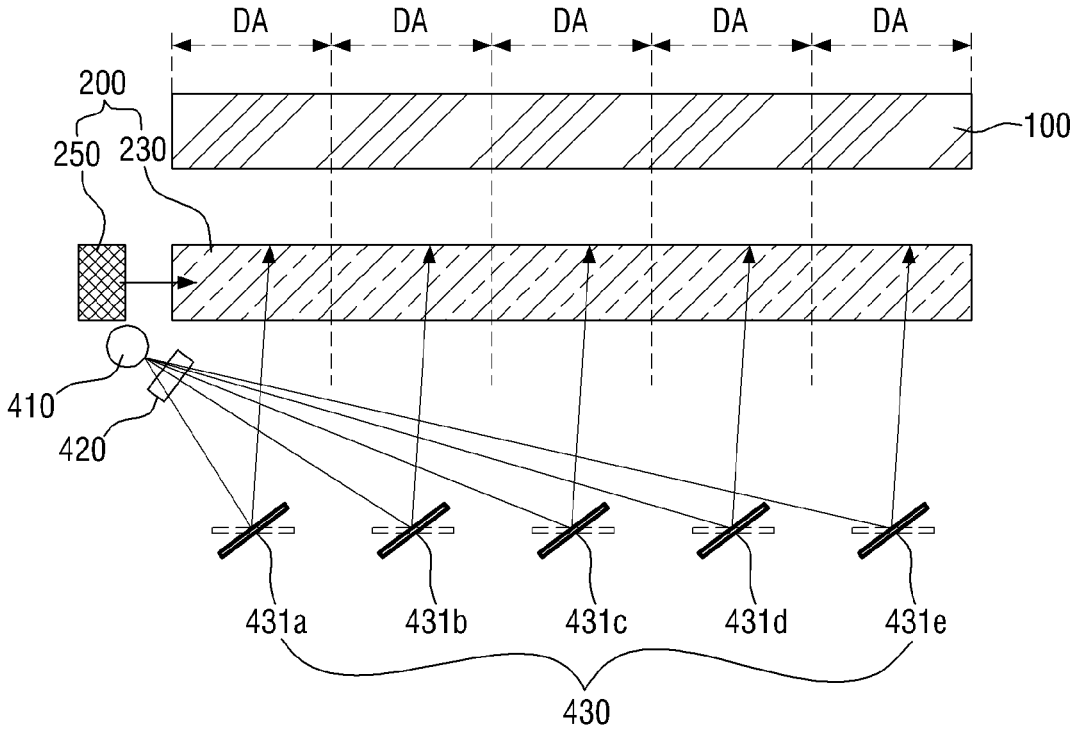
FIG. 13 is a schematic diagram illustrating the operation of the luminance boosting unit controller illustrated in FIG. 10A.

FIG. 13 is a schematic cross-sectional view of a display device according to another exemplary embodiment of the invention.

Referring to FIG. 13, a backlight unit 200 may be disposed below a display panel 100 including a plurality of display blocks DA, and a luminance boosting unit may be disposed below the backlight unit 200 and may include a plurality of light source blocks LA corresponding to the display blocks DA, respectively.

The backlight unit 200 may include a light guide panel 230 and a main light source module 250. The backlight unit 200 is the same as its counterpart of FIG. 3, and thus, a detailed description will be omitted.

The luminance boosting unit may be disposed below the backlight unit 200, and may include a light source module 410 and a plurality of micromirrors 430.

The light source module 410, like its counterpart of FIGS. 10 and 12, may include a first light source, a second light source and a third light source, and the first light source, the second light source and the third light source may be laser diodes or LEDs.

The micromirrors 430 may include a plurality of micromirrors 431*a* to 431*e* corresponding to the display blocks DA, respectively. To supply boosted light to a particular display block DA, the reflection angle of a micromirror 430 corresponding to the particular display block DA may be adjusted so as to supply light emitted from the light source module 410 to the particular display block DA.

The luminance boosting unit may also include an optical member 420 which is provided between the light source module 410 and the micromirrors 430. The optical member 420 may increase the radiation angle of light to be incident upon the micromirrors 430 from the light source module 410 and thus may improve the uniformity of light to be supplied to the micromirrors 430. In exemplary embodiments, the optical member 420 may be implemented as a micro lens array ("MLA") or an array of a plurality of lenticular lenses, but the invention is not limited thereto.

The luminance boosting unit includes only one light source module 410 in FIG. 13, but the invention is not limited thereto. That is, in other exemplary embodiments, the luminance boosting unit may include more than one light source module 410, when necessary.

According to the exemplary embodiments of the invention, since a luminance boosting unit is provided in a display device, boosted light can be supplied to individual display blocks of a display panel. As a result, the luminance, color purity and color reproducibility of the display panel can be improved in units of the display blocks, and the quality of an image displayed by the display device can be improved. Also, since basic luminance for an image to be displayed is secured by a backlight unit and the luminance boosting unit is selectively driven only when there is the need to supply boosted light to the display panel, the operating efficiency of the display device can be improved.

While the invention has been particularly shown and described with reference to exemplary embodiments thereof, it will be understood by those of ordinary skill in the art that various changes in provide and detail may be made therein without departing from the spirit and scope of the invention as defined by the following claims. The exemplary embodiments should be considered in a descriptive sense only and not for purposes of limitation.

What is claimed is:

1. A display device, comprising:

a display panel which is configured to display an image corresponding to image data input thereto and divided into a plurality of display blocks;

a backlight unit configured to supply light to the display panel and including:

a light guide panel; and a main light source module which supplies light to the light guide panel; and a luminance boosting unit configured to supply boosted light to the plurality of display blocks in addition to and separately from the light supplied from the main light source module based on the image data and including:

a light source module which emits light in addition to and separately from the light supplied from the main light source module; and a plurality of micromirrors which reflects the light emitted from the light source module and thus transmits the light to the plurality of display blocks.

2. The display device of claim 1, wherein the light source module includes:

a first light source which emits light of a first color;

a second light source which emits light of a second color, which is different from the first color; and a third light source which emits light of a third color, which is different from the first color and the second color.

3. The display device of claim 2, wherein the first light source, the second light source and the third light source are laser diodes or light-emitting diodes.

4. The display device of claim 1, further comprising:

a data detector configured to detect block image data corresponding to each of the plurality of display blocks from the image data; and a light source module driver configured to drive the light source module based on the block image data.

5. The display device of claim 4, wherein the light source module includes:

a first light source which emits light of a first color;

a second light source which emits light of a second color, which is different from the first color; and a third light source which emits light of a third color, which is different from the first color and the second color, and the light source module driver drives the first light source, the second light source and the third light source independently.

6. The display device of claim 4, further comprising:

a mirror driver configured to control the driving of the plurality of micromirrors based on the block image data.

7. The display device of claim 4, further comprising:

a block determiner configured to compare the block image data with reference data and determine one or more target display blocks of the plurality of display blocks to which the boosted light is to be supplied, based on the comparison results.

8. The display device of claim 1, wherein the number of plurality of micromirrors is the same as the number of the plurality of display blocks.

9. The display device of claim 1, wherein the plurality of micromirrors includes digital micromirror devices.

10. The display device of claim 1, wherein the main light source module faces one side of the light guide panel and includes a light-emitting diode.

11. A display device, comprising:

a display panel which is configured to display an image corresponding to image data input thereto and divided into a plurality of display blocks;

a backlight unit configured to supply light to the display panel and including a light guide panel and a main light source module which supplies light to the light guide panel; and a luminance boosting unit configured to supply boosted light to the plurality of display blocks in addition to and separately from the light supplied from the main light source module based on the image data and including a plurality of light source modules arranged to correspond to the plurality of display blocks, respectively, the plurality of light source modules emit light in addition to and separately from the light supplied from the main light source module.

12. The display device of claim 11, wherein each of the plurality of light source modules includes:

a first light source which emits light of a first color;

a second light source emitting light of a second color, which is different from the first color; and a third light source which emits light of a third color, which is different from the first color and the second color.

13. The display device of claim 12, wherein the first light source, the second light source and the third light source are laser diodes or light-emitting diodes.

14. The display device of claim 12, wherein each of the plurality of light source modules further includes a light diffuser which diffuses light emitted from the first light source, the second light source and the third light source.

15. The display device of claim 14, wherein the light diffuser includes a diffusing lens which covers the first light source, the second light source and the third light source.

16. The display device of claim 14, wherein the light diffuser includes a plurality of auxiliary light guide panels arranged to correspond to the plurality of display blocks, respectively.

17. The display device of claim 11, further comprising:

a data detector configured to detect block image data corresponding to each of the plurality of display blocks from the image data; and a light source module driver configured to drive the plurality of light source modules based on the block image data.

18. The display device of claim 17, further comprising:

a block determiner configured to compare the block image data with reference data and determine one or more target display blocks of the plurality of display blocks to which the boosted light is to be supplied, based on comparison results.

19. The display device of claim 18, wherein the block image data includes at least one of luminance data and color data of each of the plurality of display blocks.

20. The display device of claim 11, wherein the main light source module is disposed on one side of the light guide panel and includes a light-emitting diode while the plurality of light source modules are disposed on another side of the light guide panel different from the one side.

* * * * *